US009267693B2

(12) United States Patent
Knöll et al.

(10) Patent No.: US 9,267,693 B2
(45) Date of Patent: Feb. 23, 2016

(54) DECORATIVE FRAME FOR A DOMESTIC APPLIANCE, DOMESTIC APPLIANCE COMPRISING SUCH A DECORATIVE FRAME, AND METHOD FOR PRODUCING A DECORATIVE FRAME

(71) Applicant: BSH Bosch und Siemens Hausgeräte GmbH, Munich (DE)

(72) Inventors: Sebastian Knöll, Hamburg (DE); Yves Lebrun, Eschau (FR); Virginie Willmes, Fegersheim (FR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 14/358,338

(22) PCT Filed: Nov. 13, 2012

(86) PCT No.: PCT/EP2012/072436
§ 371 (c)(1),
(2) Date: May 15, 2014

(87) PCT Pub. No.: WO2013/075971
PCT Pub. Date: May 30, 2013

(65) Prior Publication Data

US 2014/0312751 A1 Oct. 23, 2014

(30) Foreign Application Priority Data

Nov. 23, 2011 (EP) ..... 11290538

(51) Int. Cl.
*F24C 15/08* (2006.01)
*F24C 15/10* (2006.01)

(52) U.S. Cl.
CPC ..... *F24C 15/108* (2013.01); *F24C 15/102* (2013.01); *Y10T 29/49826* (2015.01); *Y10T 156/10* (2015.01)

(58) Field of Classification Search
CPC ..... F24B 13/02; F24C 15/108; F24C 15/102
USPC ..... 219/452.11, 452.12; 126/211, 39 B
See application file for complete search history.

(56) References Cited

U.S. PATENT DOCUMENTS 3,017,489 A * 1/1962 Andrews ..... 219/452.11
3,561,020 A * 2/1971 Fritzsche ..... 248/313

(Continued)

FOREIGN PATENT DOCUMENTS

CN 1600719 A 3/2005
CN 101893269 A 11/2010

(Continued)

OTHER PUBLICATIONS

International Search Report PCT/EP2012/072436 dated Feb. 21, 2013.

(Continued)

*Primary Examiner* — Hanh V Tran
(74) *Attorney, Agent, or Firm* — James E. Howard; Andre Pallapies

(57) ABSTRACT

A decorative frame for a domestic appliance has an edge-side area and an inner area adjoining the edge-side area inwards. The edge-side area has a thicker section defined by a thickness which is greater than a thickness in the inner area. The thicker section in the edge-side area is realized by a separate material part which is attached to a base frame.

26 Claims, 1 Drawing Sheet

(56) References Cited

U.S. PATENT DOCUMENTS

| | | | | | |
|---|---|---|---|---|---|
| 3,679,870 | A * | 7/1972 | Opp | 219/446.1 |
| 3,838,249 | A * | 9/1974 | Detterbeck | 219/456.1 |
| 3,944,786 | A * | 3/1976 | Detterbeck | 219/445.1 |
| 4,490,603 | A * | 12/1984 | Fischer et al. | 219/456.1 |
| 4,549,052 | A * | 10/1985 | Simon | 219/623 |
| 4,608,962 | A * | 9/1986 | Ng | 126/211 |
| 4,779,605 | A * | 10/1988 | Smith et al. | 126/33 |
| 5,028,762 | A * | 7/1991 | Kicherer et al. | 219/456.1 |
| 5,571,434 | A * | 11/1996 | Cavener et al. | 219/452.12 |
| 5,791,336 | A * | 8/1998 | Helm | 126/39 H |
| 5,844,206 | A * | 12/1998 | Steiner et al. | 219/452.12 |
| 5,893,359 | A * | 4/1999 | Schultheis et al. | 126/214 A |
| 6,043,462 | A * | 3/2000 | Stedron et al. | 219/452.11 |
| 6,111,229 | A * | 8/2000 | Schultheis | 219/452.11 |
| 6,175,102 | B1 * | 1/2001 | Stedron et al. | 219/452.11 |
| 6,236,024 | B1 * | 5/2001 | Gotz et al. | 219/452.11 |
| 6,241,331 | B1 * | 6/2001 | Kammerl et al. | 312/265.5 |
| 6,255,628 | B1 * | 7/2001 | Perrino | 219/468.1 |
| 6,313,447 | B1 * | 11/2001 | Steiner et al. | 219/462.1 |
| 6,410,892 | B1 * | 6/2002 | Peschl et al. | 219/461.1 |
| 6,584,744 | B1 * | 7/2003 | Schultheis et al. | 52/396.1 |
| 2004/0155032 | A1 * | 8/2004 | Koerfer et al. | 219/622 |
| 2005/0116385 | A1 * | 6/2005 | Schultheis et al. | 264/259 |
| 2007/0169770 | A1 * | 7/2007 | Kuwamura | 126/211 |
| 2009/0127247 | A1 * | 5/2009 | Adam et al. | 219/452.11 |
| 2011/0030669 | A1 * | 2/2011 | Leikam et al. | 126/1 R |
| 2011/0100350 | A1 * | 5/2011 | Buck et al. | 126/214 A |

FOREIGN PATENT DOCUMENTS

| | | | | |
|---|---|---|---|---|
| DE | 19854229 | A1 | 5/2000 | |
| DE | 202008015025 | U1 | 3/2009 | |
| DE | 102009047686 | A1 | 6/2011 | |
| WO | WO 2009050091 | A2 * | 4/2009 | F24C 3/08 |

OTHER PUBLICATIONS

Report of Examination CN 201280057668.9 dated Jun. 17, 2015.

* cited by examiner

DECORATIVE FRAME FOR A DOMESTIC APPLIANCE, DOMESTIC APPLIANCE COMPRISING SUCH A DECORATIVE FRAME, AND METHOD FOR PRODUCING A DECORATIVE FRAME

BACKGROUND OF THE INVENTION

The invention relates to a decorative frame for a domestic appliance, with a base frame. Furthermore the invention relates to a domestic appliance with a decorative frame and also to a method for producing a decorative frame.

Domestic appliances are known in many embodiments. There are domestic appliances for preparation of food, domestic appliances for care of laundry items and domestic appliances for cleaning of crockery. It is precisely domestic appliances for preparation of food that are supplemented by a domestic appliance, which is also embodied for extracting air and is thus an air extraction facility. A steam extractor can be given as an example. Cooking devices as domestic appliances for preparation of food are likewise known in a variety of embodiments. In addition it is known that they are disposed in cutouts of a worktop of a kitchen furniture unit or the like. For this purpose an installation facility is also usually provided, with an installation frame for example, with which the appliance can be fastened into the cutout and thus also to the worktop. In addition cooking appliances, such as cooktops for example, usually also comprise a decorative frame which surrounds a cooktop plate of the cooktop, which can be of glass ceramic or glass for example, around its circumference and seals it in an upwards direction. In particular a possible gap between the cooktop plate and the cutout in the worktop is covered by said frame.

Decorative frame embodiments are likewise sufficiently well-known. In this connection designs are known which have a relatively large gap to the upper side of the worktop and in this regard a relatively large sealing element visible from outside is then required between the lower side of the decorative frame and the upper side of the worktop. In these embodiments a decorative frame is also embodied over its horizontal extent horizontally in a straight line and with the same thickness in the vertical direction.

In addition embodiments of decorative frames are known in which an edge-side area is bent downwards and accordingly can then rest on the upper side of the worktop. Here too however there is provision for the thickness of the decorative frame to be the same in its material embodiment in the bent area and in the unbent area.

In the embodiments of the known decorative frames on the one hand either very large gaps are to be sealed with seals and on the other hand expensive reshaping of the decorative frame is required.

Furthermore a plate-shaped grill is known from DE 20 2008 015 025 U1. It comprises a central grill plate and an edge profile running around the edge of the grill plate. The grill plate and the edge profile are embodied in one piece and can be of metal. A channel-like recess is embodied on the underside in an edge area. Should the edge profile not be at the same height as the grill plate the change in shape is created by a mechanical reshaping process of the one-piece component. In this case the mechanical reshaping of the remaining edge component of the plate-shaped grill below the channel-like recess running around the edge is undertaken by bending the edge profile by deep drawing of the central grill plate or by punching of the same. These processes result in shapes with little accuracy. Furthermore thinned areas must be created in the material by imprecise and inaccurate milling Furthermore such processing of a one-piece component is extremely expensive and cracks in the material or similar can occur.

BRIEF SUMMARY OF THE INVENTION

The object of the present invention is to create a decorative frame for a domestic appliance and also to create a domestic appliance in which no complicated reshaping processes are necessary.

This object is achieved by a decorative frame, a domestic appliance and a method for producing a decorative frame in accordance with the independent claims.

An inventive decorative frame for a domestic appliance comprises a base frame. The decorative frame is embodied with a thicker section in an edge-side area, so that it is thicker in the edge-side area than it is in the inner area adjoining said area to the inside. The thicker section embodied in the edge-side area is embodied by attaching a separate material part to a base frame provided separately from the material part. Through this embodiment a decorative frame with different thicknesses in different areas is able to be created, for which however no reshaping processes are required for its creation. The aforementioned problems can be avoided with this method.

Preferably the material part is attached to the underside of the base frame. This produces significant advantages in a large-area contact between the two components, which brings advantages during connection and in the mechanical stability of the connection. Furthermore the material part is covered from above and the connection is extremely resistant to stress, even with a force acting from above on the decorative frame.

Furthermore a possible sealing gap to an upper side of a receiving element, for example a worktop, is minimized or basically such a sealing gap is no longer present.

In particular there is provision for the decorative frame to extend in its edge-side area without a material reshaping or re-bending and first to be oriented quasi-horizontally. This especially enables complicated and tolerance-prone reshaping processes in relation to a re-bending or other reshaping to be avoided.

Preferably there is provision for the seal of the decorative frame embodied in the edge-side area to be embodied in the edge-side area up to an outer edge of the decorative frame. This enables undesired undercuts to be avoided, in which dust or other contamination could then penetrate.

Preferably there is provision for the thickness in the area of the thicker section to be between 10% and 500%, especially between 40% and 120%, larger than the thickness of the decorative frame in the inner area. Such a clear enlargement of the thickness in the edge-side area enables a minimization of the sealing gap to be guaranteed in an especially advantageous way, especially even direct contact between this lower side of the edge side area at the thicker section on the upper side of a receiving element of the cooktop, especially a worktop to be achieved.

Preferably there is provision for the material part to be connected to the base frame so that it is unable to be released non-destructively. A very durable and fixed-position design is achieved by this.

The base frame is preferably embodied in one plane and has an especially uniform thickness. This makes it is easy to produce.

The material part is especially attached to the lower side by a jointing process. Particular emphasis should be placed on the mechanical stability able to be achieved in such cases.

In an advantageous embodiment two initially separate parts can be connected, which are then especially connected so they cannot be released non-destructively. For example gluing or welding or thermal jointing can be provided here. Particularly advantageously, however, there is provision for the material part to be attached to the lower side by a jointing process. This makes possible an especially mechanically stable and durable connection, which in addition can then be designed and worked at the outer edge precisely so that the base frame and the material part appears as a single component in the edge-side area.

Preferably the material part and the base frame are embodied from the same material. Preferably the base frame and/or the material part are embodied from stainless steel.

In particular the material part and the base frame together at their common outer edge have a height of between 2.5 mm and 4 mm, especially between 2.5 mm and 3 mm.

Preferably there is provision for the decorative frame to be embodied from stainless steel. This is an especially outstanding material which was previously not embodied with different thicknesses at the said specific points. It is precisely a decorative frame made of stainless steel embodied in such a way with a thickness variation which is thus to be viewed as advantageous in respect of production.

In particular there is provision for the upper side of the decorative frame to extend essentially horizontally, especially completely horizontally. The decorative frame is especially embodied with four corners. The outer edges of the edge-side areas are embodied with a height of several millimeters thickness. Such an embodiment enables a real material, which is especially stainless steel, to be embodied over the entire height of the outer edge. Thus no further additional material, in the form of a sealing element for example, is to be seen over the height of the decorative frame to the upper edge of a worktop. Undesired jumps at the transitions between such a decorative frame and a sealing element are therefore no longer embodied on such an outer edge of the decorative frame.

Preferably there is provision for the edge areas of the rectangular decorative frame to be rounded. This is of particular advantage for worktops which are embodied from a glass material for example, since they still remain easy to install and do not scratch this glass material or damage it in any other way.

The invention further relates to a domestic appliance with an inventive decorative frame or to an advantageous embodiment thereof.

Preferably there is provision for an installation component of the domestic appliance, especially an installation component of an installation holder which belongs to an installation frame of the domestic appliance, to be disposed in the inner area of the decorative frame and behind the edge-side area. Such an embodiment thus enables the installation space arising to also be usefully employed for accepting further components of the domestic appliance, so that these can be embodied as low-profile as possible.

Preferably there is provision for a seal to be disposed in the inner area of the decorative frame and behind the edge-side area. This can thus be positioned hidden from the outside and is thus also delimited by this edge-side thicker section and cannot be squashed or project outwards.

Preferably the domestic appliance is embodied for food preparation and is especially a cooker. The cooker can be a cooktop or a grill or a fat fryer or a steamer or a gas cooker.

The domestic appliance can however also be an air extraction device, which is especially embodied for extraction of steam or vapor, which arises during operation of another domestic appliance, especially a cooker.

Furthermore the invention relates to a method for producing a decorative frame for a domestic appliance, in which a base frame is provided and a thicker section is embodied in an edge-side area of the base frame, so that the decorative frame is thicker in the edge-side area than in the inner area adjoining it to the inside, wherein the thicker section embodied in the edge-side area is embodied by attaching a separate material to a lower side of a base frame.

Preferably the material part is attached by a jointing process to the lower side, especially attached so that it cannot be released non-destructively.

In particular the material part is glued or welded or thermally jointed to the lower side.

BRIEF DESCRIPTION OF THE DRAWINGS

An exemplary embodiment of the invention is explained in greater detail below with reference to schematic drawings, in which.

DETAILED DESCRIPTION OF EXEMPLARY EMBODIMENTS OF THE PRESENT INVENTION

Figure 1:
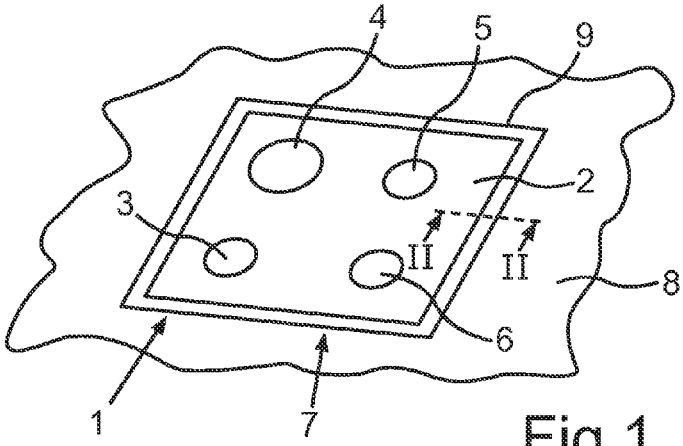
FIG. 1 shows a perspective diagram of an exemplary embodiment of an inventive domestic appliance.

In the figures elements which are the same or function in the same way are provided with the same reference characters.

FIG. 1 shows a perspective diagram of a cooking device embodied as a cooktop 1, which comprises a cooktop plate 2 which can be embodied from glass or ceramic for example. Four cooking zones 3, 4, 5 and 6, merely shown by way of example in their position and number are identified and embodied on cooktop plate 2. The cooktop 1 is disposed and fastened in a cutout 7 of a worktop 8. An installation frame not shown in the diagram is typically provided for this purpose.

The cooktop 1 additionally also comprises a decorative frame 9 separate from the installation frame, which surrounds the circumference of the cooktop plate 2 and especially also covers a gap between the cooktop 1 and the worktop 8 from above.

In the exemplary embodiment the decorative frame 9 is embodied entirely from stainless steel. It is composed of a base frame 9*g* and a material part 9*f*, which are initially provided as separate components and then connected together.

Figure 2:
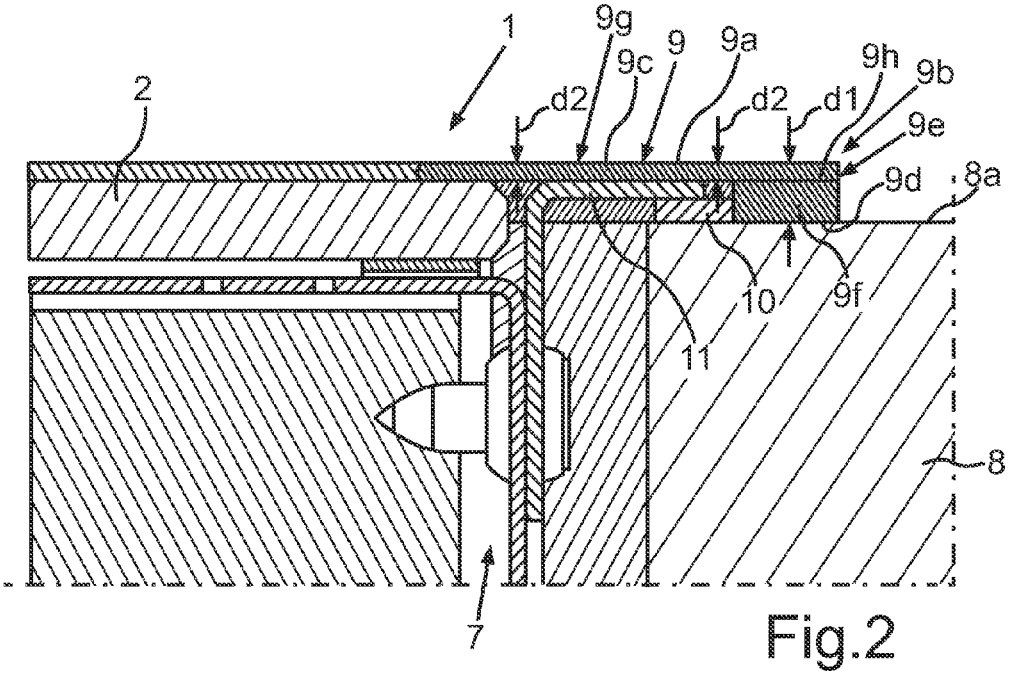
FIG. 2 shows a sectional diagram of the domestic appliance according to FIG. 1, in a side view.

FIG. 2 shows a sectional diagram through the cooktop 1 according to FIG. 1 along the cut line II-II. It can be seen that the decorative frame 9 extends with its surface 9*a* fully horizontally. The decorative frame 9 comprises an edge-side area 9*b* which, viewed in the vertical direction, has a variation in thickness in relation to other areas. In this context there is provision for a thickness d1 to be embodied in the edge-side area 9*b*, which is greater than a thickness d2 which is embodied in an inner area 9*c*. In the exemplary embodiment there is provision for the thickness d1 to be twice as great as the thickness d2.

The thickness d2 is thus embodied in an inner area 9*c* of the decorative frame 9 offset inwards in relation to the edge-side area. In the horizontal direction, viewed inwards, a free space is thus embodied adjacent to the edge-side area 9*b* and thus also behind this edge-side area 9*b* in which in the exemplary embodiment a seal 10 and a part section of an installation element 11 which belongs to an installation frame is disposed or extends inwards.

In addition it can be seen that the edge-side area 9*b* is disposed with its lower side 9*d*, which represents the lower side of the material part 9*f*, directly on an upper side 8*a* of the worktop 8.

The thicker section in the edge-side area 9*b* of the decorative frame 9 is thus embodied combined from a number of components. In this regard there is provision for an additional part, the material part 9*f* to be attached to a lower side 9*h* of the base frame 9*g*, especially to be jointed to a part embodied with the thickness d2, the plate-like and preferably flat base frame 9*g*, so that the sum thickness d1 is produced. A vertical outer edge 9*e* of the decorative frame in the exemplary embodiment is however also then embodied without steps and preferably has a height of around 3 mm.

As can also be seen, there is provision for the horizontal web of the installation element 11, on its side facing towards the edge-side area 9*b* of the decorative frame 9, to rest against the seal 10 and be in contact therewith.

The cooking device can also be a fat fryer or a plate-type grill. There can also be provision for an air extraction facility to be embodied as a domestic appliance, with which the vapor and steam arising during the preparation of food with the cooking device are able to be extracted. This air extraction device too, in addition to or instead of the decorative frame 9 of the cooktop 1, can also have a decorative frame as explained above.

The invention claimed is:

1. A decorative frame for a domestic appliance, said decorative frame comprising:

an edge-side area; and an inner area adjoining the edge-side area, the edge-side area having a thicker section defined by a thickness which is greater than a thickness of the inner area;

wherein the thicker section in the edge-side area is realized by a separate material part attached to a lower side of a base frame, the base frame extends to the edge-side area above the material part, the material part extends along the entire perimeter of the decorative frame an outside surface of the material part and an outside surface of the base frame are flush at the edge-side area such that the outside surface of the material part and the outside surface of the base frame are coplanar, the outside surface of the material part is an exposed surface of the material part, and the outside surface of the base frame is an exposed surface of the base frame, wherein the outside surface of the material part and the outside surface of the base frame are in a vertical plane when the decorative frame is in a horizontal installed position.

2. The decorative frame of claim 1, wherein the thicker section in the edge-side area is configured to extend up to the outside surface of the base frame.

3. The decorative frame of claim 1, wherein the thickness in the edge-side area is greater than the thickness in the inner area by between 40% and 120%.

4. The decorative frame of claim 1, wherein the material part is connected to the base frame so that it cannot be released non-destructively.

5. The decorative frame of claim 4, wherein the material part is attached to the lower side of the base frame by a jointing process.

6. The decorative frame of claim 1, wherein the material part and the base frame are made from a same material.

7. The decorative frame of claim 1, wherein at least one member selected from the group consisting of the base frame and the material part is made from stainless steel.

8. The decorative frame of claim 1, wherein the material part and the base frame together have a height of between 2.5 mm and 4 mm.

9. The decorative frame of claim 1, wherein the material part and the base frame together have a height of between 2.5 mm and 3 mm.

10. A domestic appliance, comprising:

an item processing area; and a decorative frame having an edge-side area, and an inner area adjoining the edge-side area, the edge-side area having a thicker section defined by a thickness which is greater than a thickness of the inner area, wherein the thicker section in the edge-side area is realized by a separate material part a lower side of a base frame, the base frame extends to the edge-side area above the material part, the material part extends along the entire perimeter of the decorative frame an outside surface of the material part and an outside surface of the base frame are flush at the edge-side area such that the outside surface of the material part and the outside surface of the base frame are coplanar, the outside surface of the material part is an exposed surface of the material part, and the outside surface of the base frame is an exposed surface of the base frame, wherein the outside surface of the material part and the outside surface of the base frame are in a vertical plane when the decorative frame is in a horizontal installed position.

11. The domestic appliance of claim 10, wherein the thicker section in the edge-side area is configured to extend up to the outside surface of the base frame.

12. The domestic appliance of claim 10, wherein the thickness in the edge-side area is greater than the thickness in the inner area by between 10% and 500%.

13. The domestic appliance of claim 10, wherein the thickness in the edge-side area is greater than the thickness in the inner area by between 40% and 120%.

14. The domestic appliance of claim 10, wherein the material part is connected to the base frame so that it cannot be released non-destructively.

15. The domestic appliance of claim 14, wherein the material part is attached to the lower side of the base frame by a jointing process.

16. The domestic appliance of claim 10, wherein the material part and the base frame are made from a same material.

17. The domestic appliance of claim 10, wherein at least one member selected from the group consisting of the base frame and the material part is made from stainless steel.

18. The domestic appliance of claim 10, wherein the material part and the base frame together have a height of between 2.5 mm and 4 mm.

19. The domestic appliance of claim 10, wherein the material part and the base frame together have a height of between 2.5 mm and 3 mm.

20. The domestic appliance of claim 10, further comprising an installation component disposed below the inner area and behind the edge-side area of the decorative frame.

21. The domestic appliance of claim 20, wherein the installation component is an installation holder.

22. The domestic appliance of claim 10, further comprising a seal disposed below the inner area and behind the edge-side area.

23. A method for producing a decorative frame for a domestic appliance, the method comprising:

attaching a separate material part to a base frame at an edge-side area of the base frame to provide a thicker section of a thickness which is greater than a thickness in an inner area of the base frame adjoining the edge-side area, wherein the thicker section in the edge-side area is realized by the material part being attached to a lower side of the base frame, the base frame extends to the edge-side area above the material part, the material part extends along the entire perimeter of the decorative frame an outside surface of the material part and an outside surface of the base frame are flush at the edge-side area such that the outside surface of the material part and the outside surface of the base frame are coplanar, the outside surface of the material part is an exposed surface of the material part, and the outside surface of the base frame is an exposed surface of the base frame, wherein the outside surface of the material part and the outside surface of the base frame are in a vertical plane when the decorative frame is in a horizontal installed position.

24. The method of claim 23, wherein the material part is attached by a jointing process to the lower side of the base frame.

25. The method of claim 23, wherein the material part is attached to the lower side of the base frame such that the material part cannot be released non destructively.

26. The method of claim 25, wherein the material part is glued or welded or thermally jointed to the lower side of the base frame.

* * * * *